United States Patent [19]

Mollenkopf et al.

[11] 4,008,995

[45] Feb. 22, 1977

[54] ROTARY KILN CONSTRUCTION

[75] Inventors: Hans Mollenkopf, Neubeckum; Ewald Angelbauer, Oelde; Jurgen Wurr; Paul Abel, both of Ennigerloh; Horst Bonisch, Neubeckum; Antonius Vering, Ahlen, all of Germany

[73] Assignee: Polysius AG, Neubeckum, Germany

[22] Filed: Nov. 21, 1975

[21] Appl. No.: 633,969

[30] Foreign Application Priority Data

Jan. 14, 1975 Germany ..... 7500800[U]

[52] U.S. Cl. ..... 432/80; 432/106

[51] Int. Cl.[2] ..... F27B 7/38

[58] Field of Search ..... 432/80, 78, 103, 106, 432/83

[56] References Cited

UNITED STATES PATENTS

| | | | |
|---|---|---|---|
| 3,384,356 | 5/1968 | Durinck | 432/103 |
| 3,502,139 | 3/1970 | Andersen | 432/80 |
| 3,794,462 | 2/1974 | Sylvest | 432/103 |
| 3,840,335 | 10/1974 | Deussner | 832/80 |
| 3,840,336 | 10/1974 | Brachthauser | 432/103 |
| 3,859,039 | 1/1975 | Heinemann et al. | 432/106 |

*Primary Examiner*—John J. Camby
*Assistant Examiner*—Henry C. Yuen
*Attorney, Agent, or Firm*—Learman & McCulloch

[57] ABSTRACT

A rotary kiln has a cylindrical casing interrupted along its length by annular members which are welded into and constitute part of the casing and which are provided with outwardly projecting, profiled webs adapted for attachment to the mounting structure of cooler tubes which are arranged in planetary manner about the casing.

8 Claims, 3 Drawing Figures

ROTARY KILN CONSTRUCTION

This invention relates to a rotary kiln having its outer periphery provided with planetary cooler tubes whose mountings are supported on an annular member.

Rotary kiln constructions are known wherein the mountings for the planetary cooler tubes are affixed to a species of annular band which is in turn affixed to the outer periphery of the kiln casing. Support plates, eg of triangular shape, have also been provided between the outer sides of a cooler tube mounting and the periphery of the kiln casing.

It has however been found in practice that in the area of the points of attachment of the mountings of the kiln casing there frequently occurs damage which is attributable to the mode of attachment of these mountings. With these types of attachment there is also no possibility of free movement for the individual cooler tube suspensions, though this may be absolutely necessary because of the thermal expansions occurring.

The invention therefore has for its objective the provision of a rotary kiln having planetary cooler tubes and wherein the mountings for the planetary cooler tubes firstly are able to move freely and secondly are effectively and reliably supported by the kiln casing.

According to the invention this objective is achieved by the provision of an annular mounting member which is welded into and constitutes a longitudinal section of the kiln casing. The mountings for the planetary cooler tubes include separate annular members, but since the welded annular member represents a longitudinal section of the actual kiln casing, there is thus produced a construction which tests have confirmed as forming a secure attachment for the cooler tube mountings and at the same time constitutes an extremely simple design. It has also been found that support plates, such as considered necessary in the known construction described above, can be dispensed with, whereby the possibility of adequately free movement for the individual cooler tube mountings is ensured.

According to an advantageous embodiment of the invention, the annular member is made of at least one rolled section with at least one profiled web projecting on the outer side. With this construction the annular member has particularly good stability, so that the embodiment is suitable especially for larger rotary kiln plants.

For smaller rotary kilns however, in accordance with a further embodiment of the invention, it can be sufficient if the annular member is made from a flat and relatively thick sheet metal strip. This embodiment is then marked by extremely favourable economy of material.

The invention will be described in more detail below with reference to the accompanying drawings, in which.

Figure 1:
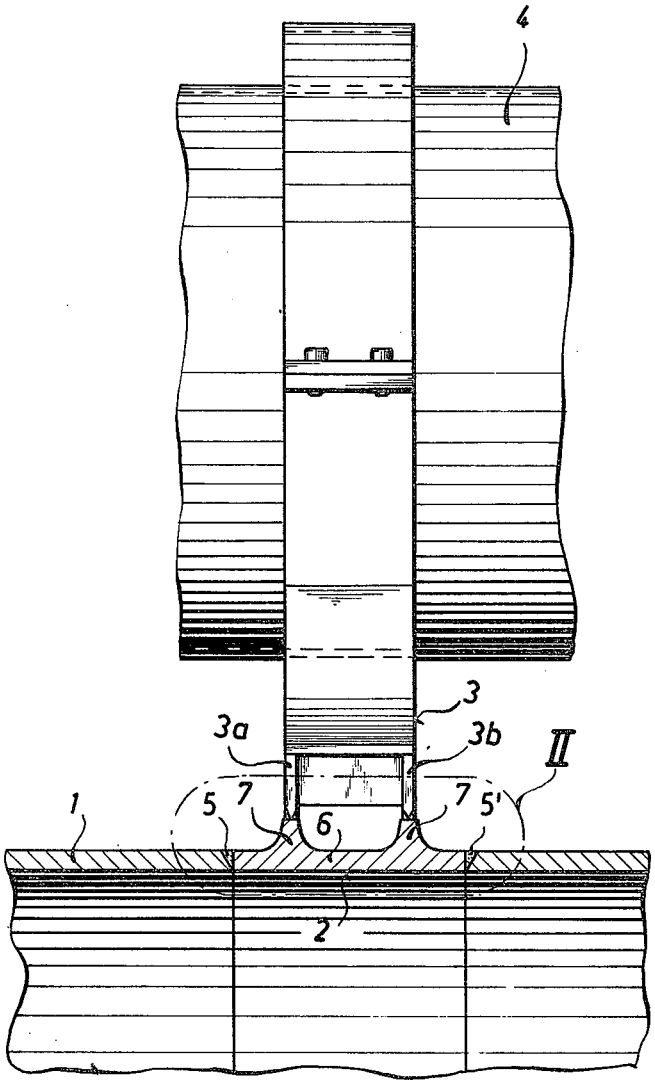
FIG. 1 is a partly cut-away section of part of a rotary kiln in accordance with the invention, illustrating the joint between a cooler tube mounting and the rotary kiln casing.

For simplicity's sake, only a partial area of the kiln casing 1 of the rotary kiln as provided by the invention is shown in cross-section in FIG. 1; the partial area involved is provided with an annular member 2 whereon are supported a plurality of mountings 3 (only one shown) for a plurality of planetary cooler tubes 4 disposed on the outer periphery of the rotary kiln. As is generally known, such planetary cooler tubes 4 are disposed at substantially regular intervals round the kiln casing, with the cooler tube axes being generally parallel to the longitudinal axis of the kiln.

With the rotary kiln construction provided by the invention, the annular member 2 forms a longitudinal section of the furnace casing 1 and is welded into the kiln casing 1 (see welding points 5,5'). In the embodiment of the invention shown in FIG. 1, the annular member 2 is made from a rolled section 6 whose inner surface is of cylindrical form and has the same internal diameter as the inner surface of the kiln casing 1 so as to provide a smooth joint at the interior of the casing. On its outer surface this rolled section annular member 2 has two circumferential, profiled webs 7 spaced apart longitudinally of the kiln, and projecting straight (radially) outwards. The mountings 3 have base plates 3a, 3b welded directly to the outer periphery of the two profiled webs; the interval between the base plates coincides with the gap between the two profiled webs 7.

As may be seen from the example in FIG. 1, the rolled section 6 produces an extremely stable annular member 2 which is particularly suitable for larger rotary kiln constructions. Thus in spite of the relatively simple construction, with its economy of material, no additional support plates need be provided on the outer sides of the mountings 3, which makes the individual cooler tube mountings 3 freely movable, so that the stresses which can arise on flexure of the kiln are effectively prevented.

While a one-piece rolled section with two profile webs is used for making the annular member 2 in the FIG. 1 construction, this could be replaced by two or more separate rolled sections for the annular member 2 longitudinally adjacent each other along the kiln casing 1. Each rolled section could for example have an outwardly projecting web to which the mountings for the planetary cooler tubes could be affixed.

Figure 2:
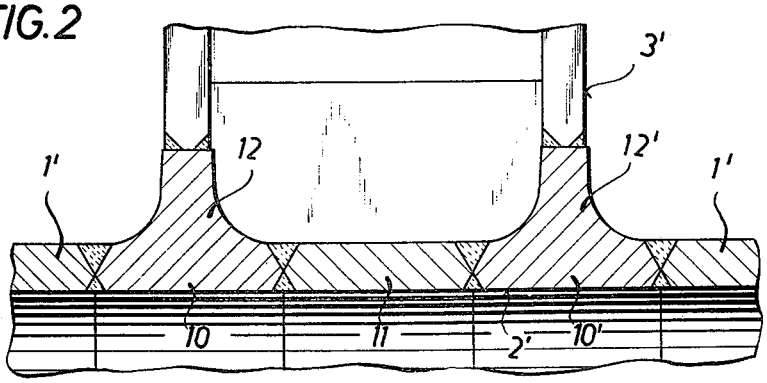
FIG. 2 is a partial section on enlarged scale (area II in FIG. 1) with a variation of the annular member shown in FIG. 1.

A similar embodiment is also shown in the partial area in FIG. 2. In this case however the annular member 2' is formed by two similar rolled sections 10, 10' spaced apart longitudinally along the kiln casing 1' and a flat sheet metal strip 11 is welded in as a connecting piece between the two rolled sections 10, 10'. The mountings 3' for the planetary cooler tubes can then again be welded directly to the outer periphery of the profile webs 12, 12'.

As may clearly be seen from the two embodiments described above, the annular member used for supporting the mountings can be adapted in simple manner to the foot portions of the cooler tube mountings. In this way it also becomes possible to give the annular member greater or lesser stability; this can naturally also be achieved by making the section or web of greater or lesser size and thickness.

Figure 3:
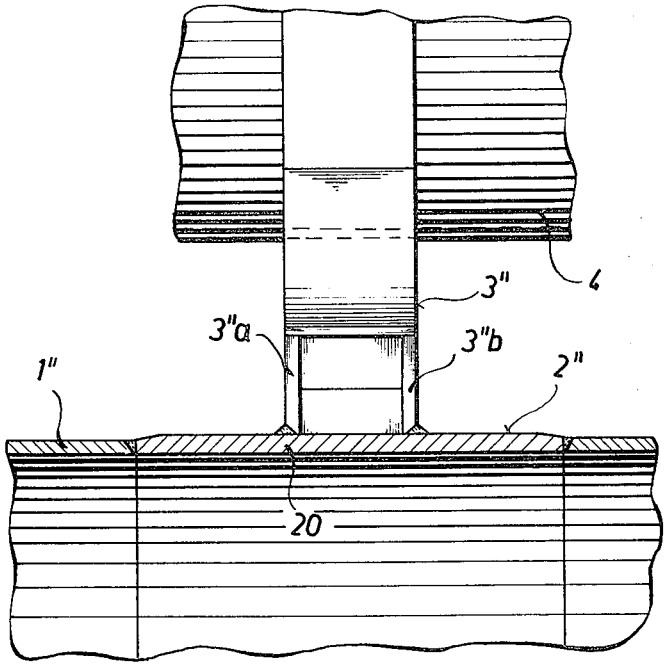
FIG. 3 is a view similar to FIG. 1, but illustrating a different embodiment of the invention.

A somewhat different and simpler form of the annular member provided by the invention can be seen from the embodiment of FIG. 3. In this instance an annular member 2'' is welded into the kiln casing 1'' as a longitudinal section of that casing, and consists merely of a flat and relatively thick sheet metal strip 20 which is thicker than the wall of the kiln 1. A smooth joint is provided at the inner surface of the casing, the strip 20 projecting beyond the periphery of the casing. In this case the mountings 3'' for the planetary cooler tubes 4 have their foot portions 3''*a*, 3''*b* directly welded onto the exterior of the annular member 2''.

This particularly simple embodiment is expecially suitable for smaller kilns, in which lesser sheet metal thicknesses are used for the kiln casing.

What is claimed is:

1. A rotary kiln having an elongate, cylindrical casing provided with planetary cooling tubes spaced circumferentially about said casing, and attaching means for attaching each of said tubes to said casing, said attaching means comprising at least one annulus welded into and constituting a longitudinal section of said casing, said annulus having an internal diameter corresponding to that of said casing and having a wall thickness at least as great as that of said casing, a mounting member carried by each of said cooling tubes, each of said mounting members having a predetermined width in a direction axially of said casing, and supporting means extending radially outwardly of said annulus and being secured to the latter and to each of said mounting members, each of said supporting means consisting of a pair of members spaced from one another axially of said casing a distance corresponding to the width of the associated members.

2. A kiln according to claim 1 wherein said annulus comprises a rolled section.

3. A kiln according to claim 1 wherein said annulus comprises at least a pair of rolled sections joined to one another end-to-end.

4. A kiln according to claim 1 wherein said annulus comprises a pair of rolled sections spaced from one another longitudinally of said casing, and a sheet metal strip interposed between and joined to said pair of rolled sections.

5. A kiln according to claim 4 wherein the supporting means for said tubes comprises a profiled web forming an integral part of each of said rolled sections and projecting outwardly thereof.

6. A kiln according to claim 1 wherein the supporting means for said tubes comprises at least one profiled web forming an integral part of said annulus and projecting outwardly of the latter.

7. A kiln according to claim 6 wherein the mounting member for each of said tubes comprises an annulus welded to said web.

8. A kiln according to claim 1 wherein said annulus has a wall thickness greater than that of said casing.

* * * * *